United States Patent [19]

Meyer

[11] 3,942,296

[45] Mar. 9, 1976

[54] TUBULAR POLE WITH BASE CONNECTION

[75] Inventor: Roy Edwin Meyer, Red Wing, Minn.

[73] Assignee: International Telephone and Telegraph Corporation, New York, N.Y.

[22] Filed: Oct. 7, 1974

[21] Appl. No.: 512,559

[52] U.S. Cl. ..... 52/296; 52/298

[51] Int. Cl.[2] ..... E02D 27/42

[58] Field of Search ..... 52/295, 292, 296, 297, 52/298, 247; 287/20 R, 20.2 WS; 248/357, 25

[56] References Cited

UNITED STATES PATENTS

| | | | |
|---|---|---|---|
| 723,669 | 3/1903 | Hammann | 52/292 |
| 1,906,634 | 5/1933 | Leahe | 52/298 X |
| 3,093,215 | 6/1963 | Scribens | 52/292 X |
| 3,219,371 | 11/1965 | Danly | 287/20 |
| 3,353,852 | 11/1967 | Woot | 287/20 R |
| 3,414,227 | 12/1968 | Beullzer et al. | 248/357 |
| 3,645,057 | 2/1972 | Kaplan | 52/296 X |
| 3,713,262 | 1/1973 | Jatcho | 52/296 |
| 3,839,835 | 10/1974 | Meyer | 52/296 |

FOREIGN PATENTS OR APPLICATIONS

| | | | |
|---|---|---|---|
| 76,767 | 10/1961 | France | 52/297 |
| 932,312 | 7/1963 | United Kingdom | 248/357 |

*Primary Examiner*—Frank L. Abbott
*Assistant Examiner*—Carl D. Friedman
*Attorney, Agent, or Firm*—James B. Raden; Marvin M. Chaban

[57] ABSTRACT

A tapered tubular pole with base connection wherein the tubular multi-sided pole wall is connected to the anchor bolts of the concrete and steel base by a multiplicity of individual connector bodies arranged in side by side relation around the periphery of the tubular sidewall at the lower end thereof, each of the connector bodies having a structural flange bearing against the outside of the tubular sidewall and connected thereto by a structural weld, the connector body having anchor bolt-receiving holes, and a diaphragm extending transversely across the pole and within the tubular sidewall and at the level of the structural welds by which the connector bodies are connected to the sidewall, the diaphragm being affixed to the sidewall.

11 Claims, 5 Drawing Figures

FIG. 1
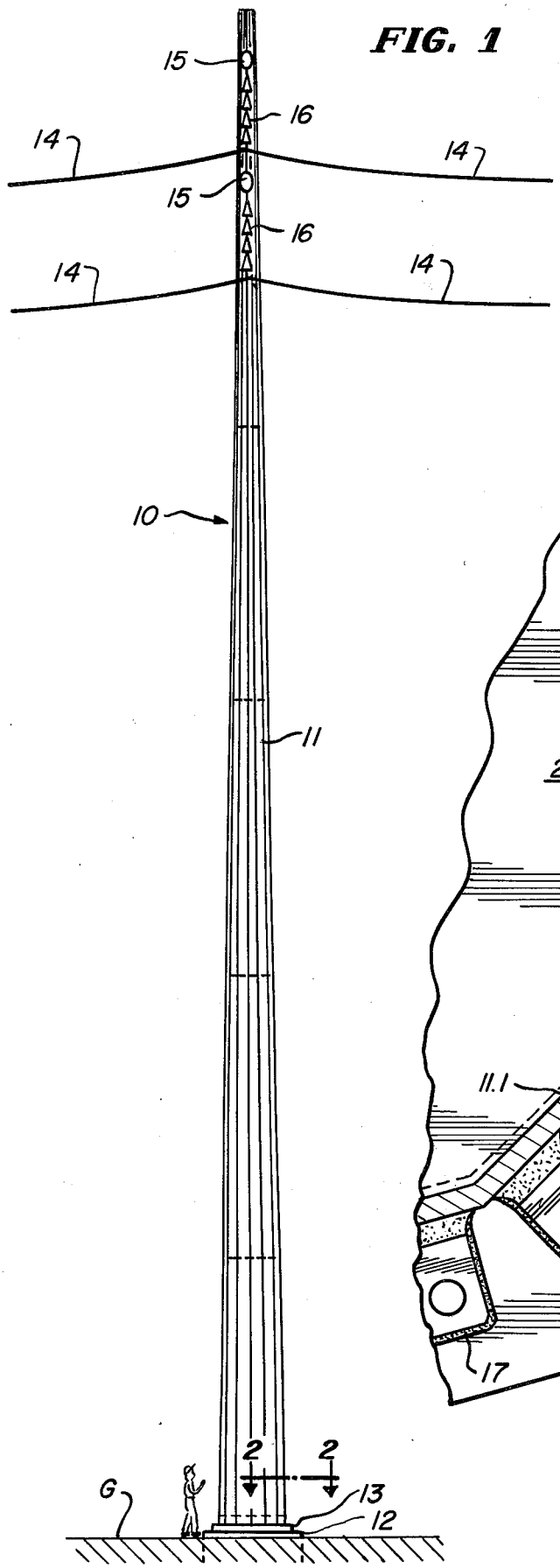
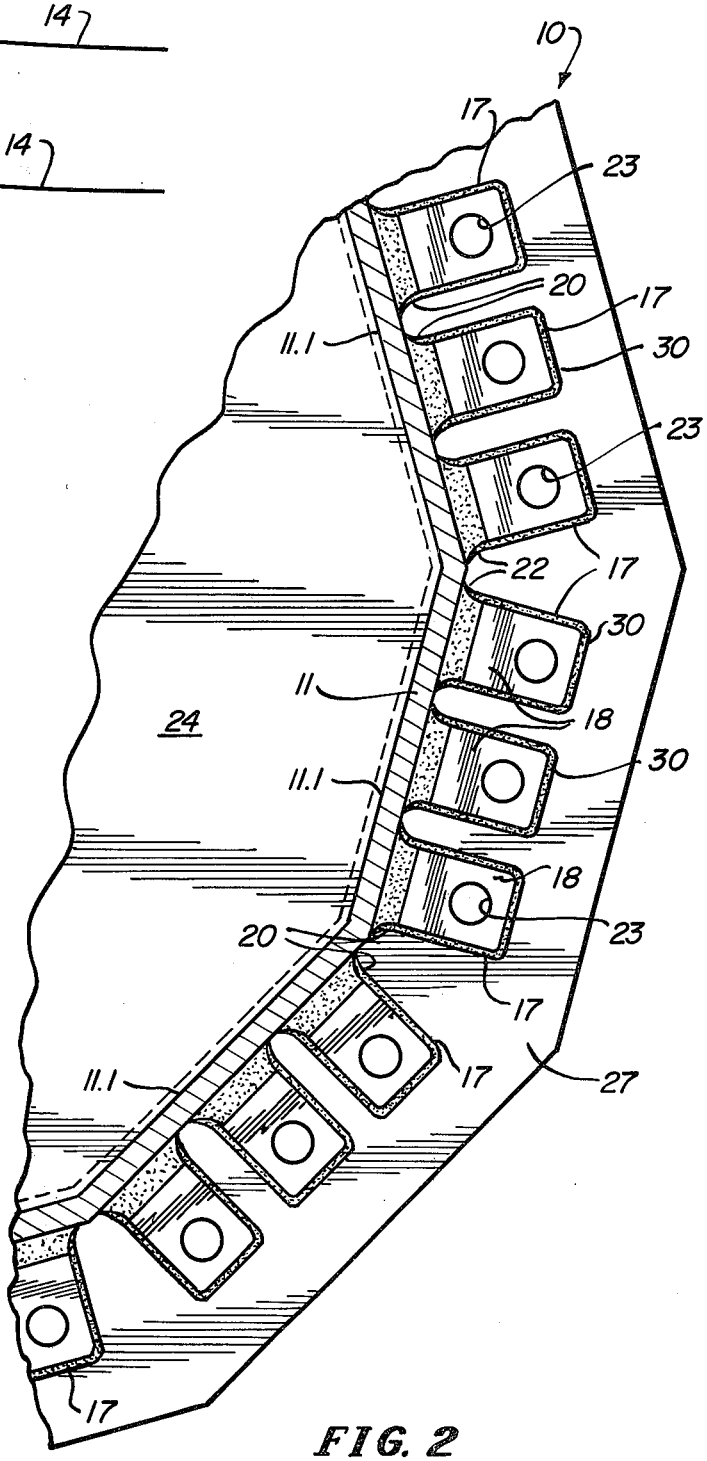
FIG. 2

FIG. 3
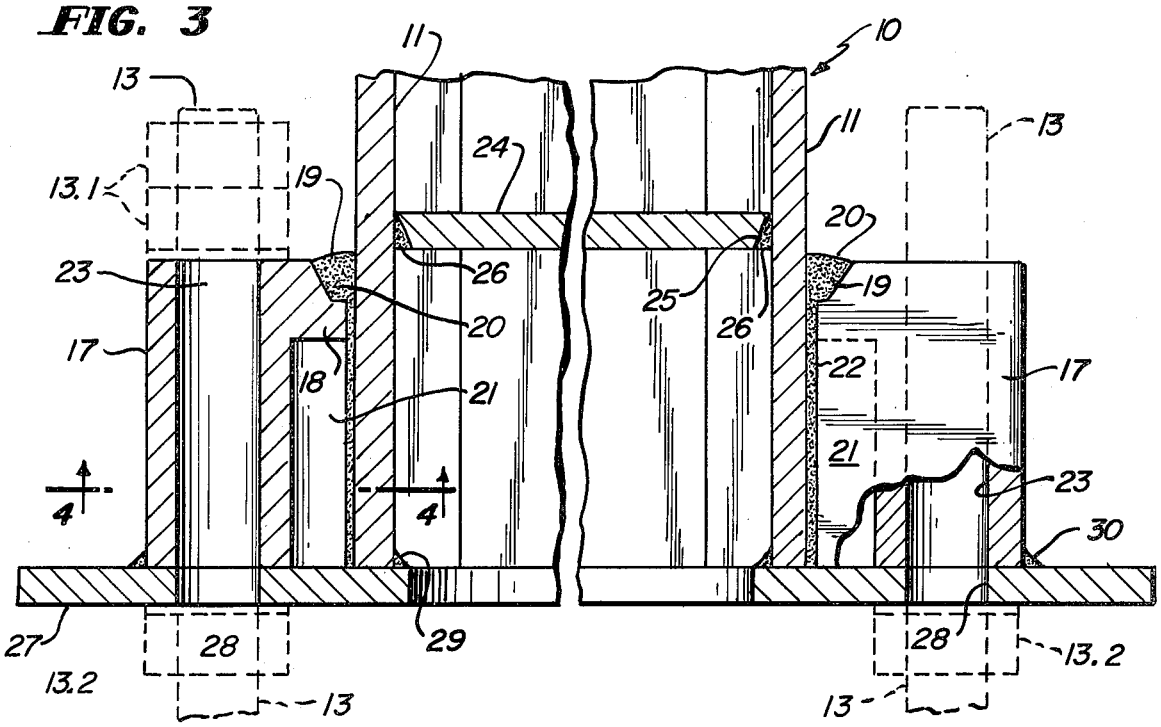
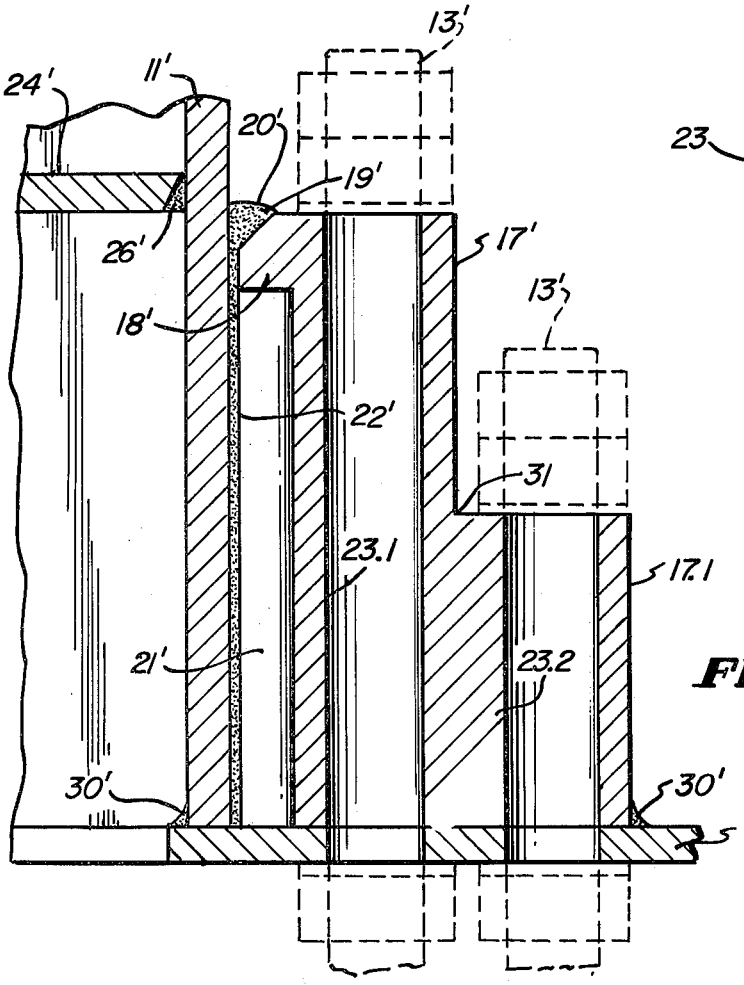
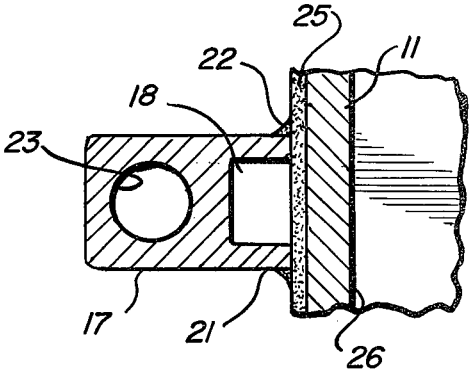
FIG. 4
FIG. 5

TUBULAR POLE WITH BASE CONNECTION

BACKGROUND OF THE INVENTION

Tubular poles of various shapes have been used for supporting high voltage electric power transmission lines and lighting systems for several years. The poles are normally fabricated of steel plate but could be fabricated from other suitable materials, and have eight or 12 or more flat sides. The poles taper convergently toward the top and the flat sided walls of the poles are much thicker at the bottom of the pole than at the top to withstand loading.

Such poles must withstand loading caused by the weight of the transmission lines, and also caused by the wind applying horizontal forces on the lines and poles thereby tending to bow or flex the poles. Unusual loading must also be expected and planned for, such as the loading caused by ruptured transmission lines which may apply forces in many directions on the poles, but often will apply torsion forces tending to twist the pole about upright axes extending longitudinally through the pole.

It is significant to note that such tubular towers are usually used without guying, even at corners and dead-end locations in transmission lines. Also of particular significance is that such towers are used to support extremely heavy loads at extreme elevations. Poles of 110 to 125 feet in height are very common, and poles of 160 to 180 feet in height are not uncommonly used.

All of the loading on the tubular towers must be transmitted to its base in the ground. Such bases are of steel and concrete extending deep into the ground and long anchor bolts extending down through the base. The anchor bolts protrude slightly from the top of the base to connect to the pole.

In the past, it has been common practice to weld a steel base plate across the bottom of the pole with the edge of the base plate protruding outside of the periphery of the pole for receiving the anchor bolts. The entire loading on the pole is borne by the base plate which therefore must be extremely strong and tough.

However, there are practical limits to the sizes in which such base plates can be manufactured. For instance, the base plate of high quality steel must be approximately 9 inches thick and 6 to 8 feet across for towers of 110 feet to 160 feet in height, depending upon loading. Of course, base plates for higher towers must be still thicker and larger in width.

A major problem with such large and thick base plates is that they are often not homogeneous throughout. The steel must be strong and tough, and not brittle. The thicker the plate the less likely it is to be homogeneous. Of course, failure of a base plate caused by brittleness may cause collapse of a vital pole in a transmission line, and loss or outage of the transmission line can be a very dangerous and expensive situation.

BRIEF SUMMARY OF THE INVENTION

The present invention provides for the elimination of the base plate of a high strength tapered tubular pole for connection to the anchor bolts of the pole base. This invention also serves to accomplish effective and efficient transfer of the bending moment or force of a tubular pole to the pole's foundation system.

The connection between the pole and the base is provided by a plurality of individual connector bodies welded to the exterior surface of a flat sided wall of the pole at the lower end of the pole. The pole and the connector bodies are fabricated from any suitable structural materials, preferably steel plate; the material employed to fabricate the connector bodies being selected on the basis of compatibility for welding purposes with the structural material from which the pole is fabricated.

Each connector body is located at and has an upright hole to receive a respective anchor bolt of the base, or may have holes to receive tandemly arranged anchor bolts at one location peripherally of the tower. A main structural weld between the wall of the pole and each connector body extends across the top of the connector body.

The invention also includes as a part of the connection, a diaphragm, which is also fabricated from a suitable and compatible structural material, preferably steel plate, lying transversely of the pole and located within the pole opposite the main structural welds across the tops of the connector bodies which are spaced about the periphery of the pole wall. The periphery of the diaphragm conforms to the shape of the interior periphery of the flat sided pole wall and is welded thereto.

The diaphragm serves to distribute transverse loading or forces to various parts of the pole wall and to various of the connector bodies and anchor bolts.

The external connector bodies may be arranged about the pole wall to conform to the loading expected, and may be regularly spaced about the periphery, or may be clustered in close spacings at certain portions of the wall periphery, and more widely dispersed at other portions of the wall periphery.

BRIEF DESCRIPTION OF THE DRAWINGS

FIG. 1 is an elevation view of a transmission line pole incorporating the present invention.

FIG. 2 is a greatly enlarged detail section view taken approximately at 2—2 in FIG. 1.

FIG. 3 is an enlarged detail section view taken entirely through the lower end of the pole with the central portion of the pole wall and diaphragm broken away.

FIG. 4 is an enlarged detail section view taken approximately at 4—4 in FIG. 3.

FIG. 5 is an enlarged detail section view similar to FIG. 3, but showing a modified form of the invention.

DETAILED DESCRIPTION OF THE INVENTION

The tapered tubular pole is indicated in general by numeral 10 and has a sidewall 11 formed with a multiplicity of flat sides 11.1, each being at an oblique and obtuse angle with respect to the adjacent sides. The cross-sectional configuration of the pole 10 may be oblong or generally elliptical so that the pole will have greater dimensions in one transverse direction than in another transverse direction. Otherwise, the pole may be flat sided and generally round so that all of the transverse dimensions of the pole are equal. Additionally, the pole may be formed with eight or 12, or some other number, flat sides, but in the drawings, the tower is illustrated to have 12 flat sides, and to have an oblong or generally elliptical cross-sectional configuration. The sidewall 11 may be fabricated from a number of sheets of steel which progressively vary in thicknesses from the bottom to the top of the pole and, of course, the thickest and strongest steel plate is used at the bottom of the pole. Alternatively, the sidewalls may be fabricated of other suitable structural materials such as aluminum, fiberglass, structural metallic alloys, and the like.

As illustrated in FIG. 1, a concrete and steel reinforced base 12 is constructed in the ground G, and anchor bolts 13 protrude upwardly from the base 12 in a predetermined pattern, for securing the base 12 to the pole 10.

The pole 10 is typically used to support a high voltage power transmission line 14, and, accordingly, will have suitable crossarms 15 which suspend the insulators 16 on which the transmission line 14 is mounted.

The base connection between the tubular pole wall 11 and the anchor bolts 13 is in the form of a plurality of connector bodies 17 which as illustrated are substantially of rectangular block configuration. These connector bodies are preferably formed of a hypoeutectic steel alloy so as to be weldable. However, the connector bodies may be formed from any suitable structural material such as aluminum, fiberglass, structural metallic alloys and the like which are compatible with the sidewall material to enable structural connection such as weld connection therebetween.

Manufacture of the connector bodies 17 from steel alloy is preferably accomplished by forming rolled steel plate into the desired shape such as the rectangular block configuration best illustrated in FIGS. 2 and 3. As depicted, these connectors 17 have relatively thin sections so as to prevent the creation of undesired stresses by the welding heat.

It will be seen in FIGS. 2 and 3, that a multiplicity of the connector bodies are utilized in rather closely spaced relation at a multiplicity of positions around the periphery of the tubular pole wall 11 and at the lower end of the wall. The connector bodies may be variously located around the periphery of the tubular wall 11, depending upon the loading which may be applied to the tower. In the form illustrated, the connector bodies 17 are regularly spaced around the periphery of the tubular pole wall; however, it may be desirable to widely space the connector bodies from each other at certain peripheral portions of the pole and to cluster the connector bodies 17 together into closely spaced relation at other portions of the periphery of the tubular pole wall.

As seen in FIGS. 3 and 4, each of the connector bodies 17 has a structural connecting flange 18 which extends inwardly to the outer surface of the pole wall 11. The structural flange 18 of each of the connector bodies extends across the full width of the connector body and has a bevel 19 or cutaway portion at the top front corner which, when the connecting flange 18 is disposed in confronting relation with the pole wall 11, forms a groove to receive the main structural full penetration weld 20 which entirely fills the beveled space and transfers the full load between the connector body 17 and the adjacent portion of the pole wall 11. It will be noted that the depth of the weld 20 from top to bottom is of the same order of dimension as the thickness of pole wall 11, and the structural connecting flange 18 is also of the same order of thickness as the thickness of the pole wall 11.

Each of the connector bodies 17 also has a pair of upright and inwardly extending confining flanges 21, at opposite sides of the connector body and depending from the opposite ends of the structural connecting flange 18. The confining flanges 21 serve to confine the space beneath the flange 18 which is left open in order to minimize the sectional thickness of the adjacent portions of the connective body so as to prevent creation of undue stresses which would otherwise be caused by welding heat. The edges of the flanges 21 are affixed to the pole wall 11 by fillet welds 22.

Each of the connector bodies 17 also has an elongate upright anchor bolt-receiving hole 23 extending entirely from top to bottom through the connector body. The anchor bolt 13 will extend through the hole 23 and protrude sufficiently above the connector body so that clamping and locknuts 13.1 may be threaded onto the threaded anchor bolt to affix the connector body and pole in the desired position relative to the base 12.

A diaphragm 24 preferably fabricated from steel plate is confined wholly within the tubular pole wall 11 and is oriented transversely of the wall 11. The periphery of the diaphragm 24 conforms to the multi-sided shape of the tubular tower wall 11. It is important that the diaphragm 24 be disposed adjacent the upper portions of the several connector bodies 17 welded to the outside of the pole wall. The peripheral edge 25 of the diaphragm is beveled and is obliquely shaped as relates to the plane of the diaphragm 24 so as to define a groove in cooperation with the inner surface of the pole wall 11. A weld 26 which may be a full penetration weld but preferably a fillet weld is applied between the peripheral edge of diaphragm 24 and the inner surface of pole wall 11, and extending around the entire periphery of the diaphragm and pole wall so as to affix the diaphragm integrally to the pole opposite the upper portions of the connector bodies 17. The diaphragm 24 absorbs and distributes transversely oriented forces, both compression and tension, which are applied between the connector bodies 17 and the pole wall 11. The diaphragm 24 cooperates with the pole wall in preventing the exertion of extremely high compression or tensile forces at any particular connector body 17 and distributes the compressive and tensile forces throughout a number of connector bodies which are adjacent each other. The diaphragm 24 has the same order of thickness and strength as the adjacent tubular pole wall 11, although the actual strength characteristics of the diaphragm will vary somewhat depending upon the overall loading which is to be applied to the pole.

The pole 10 may also be provided with a tie plate 27 preferably fabricated of steel which is annular in shape and which underlies the lower end of the tubular pole wall 11. The tie plate 27 also underlies the band of connector bodies which are disposed in side by side relation around the periphery of the pole wall 11. The tie plate 27 has a plurality of anchor bolt-receiving holes 28, and each of the holes 28 is aligned with a respective anchor bolt-receiving hole 23 of one of the connector bodies 17. The interior periphery of the annular tie plate 27 is located slightly inwardly of the inner periphery of the pole wall 11 and is secured to the lower end of the pole wall as by a fillet weld 29. Each of the connector bodies 17 bears against the upper surface of the tie plate 27, and a weld 30 such as a fillet weld extends around the lower edge of the connector body affixing the connector body to the tie plate 27. As illustrated in FIG. 3, the anchor bolts 13 extend through the aligned holes 28 and 23 in the tie plate and connector bodies respectively, and leveling nuts 13.2 on the anchor bolts 13 underlie the tie plate 27 for supporting the pole 10 and cooperating with the nuts 13.1 in clamping the connector bodies 17 and tie plate 27 and thereby affixing the pole 10 to the base 12 in proper position.

It will be recognized that when the pole 10 is erected and in operating condition as illustrated in FIG. 1, all of the loading of the pole 10 is transmitted to the base 12 through the connector bodies 17 and anchor bolts 13. Under certain load conditions, the forces exerted through the connector bodies 17 and structural welds 20 will be compressive, and in other load situations, the connector bodies 17 and main structural welds 20 will be under tension. Likewise, under certain load conditions, one peripheral portion of the diaphragm 24 and the adjoining portions of the weld 26 will be under compression while the remainder of the disc 24 together with the adjacent portions of weld 26 will be under tensile forces; and under varying load conditions from time to time, the various portions of the diaphragm 24 and weld 26 will vary between compression and tensile forces. As a result of the use of the connector bodies together with the diaphragm 24, the loads applied from the tubular pole wall 11 to the base are distributed over a larger area and because of the larger area, the loads applied at any one location are significantly less.

In the modified form of the invention illustrated in FIG. 5, all of the features of the form of the invention illustrated in FIGS. 1–4 are incorporated and, in addition, provision is made for securing each of the connector bodies to a pair of tandemly arranged anchor bolts, both disposed at one location along the periphery of the tubular pole wall, but disposed in tandem relation to each other at various distances from the pole wall.

More specifically, in FIG. 5, the tubular pole wall 11' is supported and connected to the base by the connector body 17'. The connector body 17' has a structural connecting flange 18', beveled at 19' and affixed by the main structural full penetration weld 20' to the adjacent pole wall 11'. The connector body 17' has one of its anchor bolt-receiving holes 23.1 extending entirely from top to bottom through the connector body, and the outer portion 17.1 is of reduced height and has a top shoulder 31 spaced below the top of the body 17'. The second anchor bolt-receiving hole 23.2 extends entirely from the botton of the connector body through the outer portion 17.1 and upwardly through the shoulder 31. The diaphragm 24' is an important part of the pole employing the multiplicity of connector bodies 17 for connecting the pole to the anchor bolts 13'. The disc 24 is similarly oriented and located as described in connection with FIGS. 1–4, and the edge of the disc is affixed to the pole wall by a weld 26' located opposite the plurality of structural welds 20' at the tops of the connector bodies 17'. The double bolt form illustrated in FIG. 5 permits the anchor bolts to be tandemly arranged at different spacings from the pole wall 11' so as to increase the available number of anchor bolts for taking the load of the pole while the width of the connector body 17' need not be increased beyond that illustrated in FIG. 2 wherein only a single anchor bolt hole is provided in the connector body. As in the other form of the invention, the form illustrated in FIG. 5 also has the confining flanges 21' connected by fillet welds 22' to the pole wall 11', and a tie plate 27' is also provided beneath the lower end of the pole wall and beneath the connector body and is connected thereto by fillet welds 29' and 30'.

It will be seen that I have provided a new and improved tubular multi-sided pole with base connection for connection to the concrete and steel base which supports the pole without guying. The base connection requires a multiplicity of connector bodies arranged in side by side relation around the periphery of the tubular pole wall and at the lower end thereof. These connector bodies are attached to the pole wall by main structural full penetration weld and have anchor bolt-receiving holes for attachment to the anchor bolts which are a part of the base. A diaphragm traverses the inside of the tubular pole wall opposite the main structural weld by which the connector bodies are affixed to the pole wall. The diaphragm is also a main structural member, having the same order of thickness and strength characteristics as the pole wall and is affixed to the pole wall by a fillet weld or by a full penetration structural weld so as to absorb and distribute tensile and compressive forces among several connector bodies at various portions of the periphery of the tubular pole wall. It will further be seen that a tie plate may be provided beneath the pole wall and connector bodies to protect the connector bodies from damage. The lower portions of the connector bodies and the tie plate are secured to the pole wall by fillet welds and are secured together by fillet welds.

I claim:

1. A pole with base connection to be supported on a concrete and metal base with anchor bolts comprising:

an upright tubular pole wall having a lower end to be supported upon such a base;

a plurality of elongate upright connector bodies in spaced and side by side relation to each other and lying against the exterior of the pole wall adjacent the bottom of the pole, each of said bodies having a substantially retangular block-like configuration with the top surface thereof being spaced above the lower edge of the pole wall and with the bottom surface disposed adjacent the lower edge of the pole wall, each of the bodies having a structural connecting flange projecting horizontally to the pole wall at the top surface of the body, each of the bodies having an upright anchor bolt receiving hole entirely therethrough and through the top and bottom surfaces thereof and the structural flange of each connector body being affixed to the pole wall by a main structural weld therebetween and extending across the top of the flange; and a diaphragm within the tubular pole wall and oriented transversely of the pole wall, the diaphragm conforming to the shape of the interior periphery of the tubular pole wall and being affixed to the pole wall, the diaphragm being disposed opposite the tops of the connector bodies and the structural welds and distributing transverse compressive and tensile loading among several of the connector bodies.

2. The pole with base connection according to claim 1 wherein each of said pole wall, said connector bodies and said diaphragm are fabricated of steel plate.

3. The pole with base connection according to claim 1 wherein said diaphragm is affixed to said pole wall by welding.

4. The pole with base connection according to claim 1 and including a steel tie plate underlying the pole wall and all of the connector bodies and having anchor bolt holes in alignment with the holes of the connector bodies, the tie plate being secured to the pole wall and connector bodies with fillet welds.

5. The pole with base connection according to claim 1 and said hole extending through the top of the connector body adjacent the structural weld, each of said connector bodies having a second upright anchor bolt receiving hole, said holes being spaced from each other in a direction transversely of the pole wall, said holes being arranged in tandem with each other at one location along the periphery of the pole wall.

6. A pole with base connection to be supported on a concrete and steel base with anchor bolts, for carrying transmission lines and the like, comprising:

an upright tubular steel plate pole wall having a lower end to be supported upon such a base;

a plurality of elongate upright steel connector bodies in spaced and side by side relation to each other adjacent the bottom of the pole, each of said connector bodies having a structural connecting flange projecting horizontally against the pole wall and being affixed thereto, each of the bodies having an upright anchor bolt receiving hole entirely therethrough and each connector body being affixed to the pole wall by a main structural weld therebetween, and a steel plate diaphragm within the tubular pole wall and oriented transversely of the pole wall, the diaphragm conforming to the shape of the interior periphery of the tubular pole wall and being affixed to the pole wall, the diaphragm being disposed opposite the tops of the connector bodies and the structural welds and distributing transverse compressive and tensile loading among several of the connector bodies.

7. The connector with base connection according to claim 6 wherein said flange extends transversely across substantially the entire width of the body and has a bevelled top corner across the full width of said flange and adjacent the pole wall.

8. The connector with base connection according to claim 6 wherein each of said connector bodies has a pair of upright confining flanges respectively disposed at opposite sides of the body and both projecting toward the pole wall to confine the space beneath the structural connecting flange.

9. The connector with base connection according to claim 7 and including fillet welds connecting the confining flanges to the pole wall.

10. A pole with base connection to be supported on a concrete and steel base with anchor bolts, for carrying transmission lines and the like, comprising:

an upright tubular steel plate pole wall having a lower end to be supported upon such a base;

a plurality of elongate upright steel connector bodies in spaced and side by side relation to each other adjacent the bottom of the pole, each of the connector bodies having a structural connecting flange projecting horizontally against the pole wall, the flange extending transversely across substantially the entire width of the connector body and having a bevelled top corner across the full width of the flange and adjacent the pole wall, each of the connector bodies being affixed to the pole wall by a main structural weld therebetween and extending across the top of the flange at said bevelled top corner, and each of the connector bodies having an upright anchor bolt receiving hole extending entirely therethrough from the top to the bottom of the body, and means confining the space below said structural flange and between the connector body and the pole wall, and each of said connector bodies having an inner side adjacent the pole wall, and also having an outer side defining a shoulder beneath the top of the body, each of the connector bodies having a second upright anchor bolt receiving hole extending entirely through the outer side of the body from the shoulder to the bottom; and a steel plate diaphragm within the tubular pole wall and oriented transversely of the pole wall, the diaphragm conforming to the shape of the interior periphery of the tubular pole wall and being welded to the pole wall, the diaphragm being disposed opposite the tops of the connector bodies and the structural welds and distributing transverse compressive and tensile loading among several of the connector

11. A pole with base connection supported on a steel and concrete base with anchor bolts, for carrying high voltage transmission lines and the like, comprising:

an upright tubular and flat sided steel plate wall tapering convergently in an upward direction and having a lower end to be supported upon such a base;

a plurality of elongate and upright connector bodies, said upright connector bodies being disposed in spaced and side by side relation to each other and lying against the exterior of the steel plate pole wall adjacent the lower end thereof, each of said connector bodies having a structural connecting flange projecting horizontally inwardly against the pole wall, the flange extending transversely across substantially the entire width of the connector body and having a beveled top cornor across the full width of the flange and adjacent the pole wall, each connector body being affixed to the pole wall by a main structural weld in said beveled top corner and extending across the top of the connector body to rigidly secure the structural connecting flange of the connector body to the pole wall, each of the bodies also having an upright anchor bolt receiving hole entirely therethrough, each of said connector bodies also having a pair of upright space-confining flanges respectively disposed at opposite sides of the connector body and respectively depending from the structural flange and in close proximity with the steel plate pole wall, said confining flanges being connected to the pole wall with fillet welds, the sectional thickness in the connector bodies being minimal consistent with strength requirements thereby preventing undesired stresses due to welding heat;

a steel diaphragm within the tubular pole wall and oriented transversely of the pole wall, the diaphragm conforming to the shape of the interior periphery of the pole wall and being welded to the pole wall at a location opposite the main structural welds between the connector bodies and the pole wall, the steel plate diaphragm having thickness and strength characteristics of the same order as the tubular pole wall to distribute transverse compressive and tensile forces among several of the connector bodies; and an annular tie plate underlying the lower end of the tubular pole wall and also underlying the connector bodies, said tie plate having anchor bolt holes in alignment with the holes of the connector bodies and being secured to the pole wall and connector bodies with fillet welds.

* * * * *

UNITED STATES PATENT OFFICE

CERTIFICATE OF CORRECTION

Patent No. 3,942,296 Dated March 9, 1976

Inventor(s) Roy Edwin Meyer

It is certified that error appears in the above-identified patent and that said Letters Patent are hereby corrected as shown below:

The term of this patent subsequent to October 8, 1991 has been disclaimed.

Column 6, line 33, "retangular" should read -- rectangular --.

Column 8, line 14, after "connector" add -- bodies --.

Column 8, line 31, "cornor" should read -- corner --.

Column 5, line 43, "botton" should read -- bottom --.

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*